US008033711B2

(12) United States Patent
Mobarak et al.

(10) Patent No.: US 8,033,711 B2
(45) **Date of Patent: *Oct. 11, 2011**

(54) FIELD BENDABLE LINE VOLTAGE TRACK LIGHTING SYSTEM

(75) Inventors: Aaron Mobarak, Chicago, IL (US); Victor Smith, Oak Park, IL (US); Christopher Watson, Oak Park, IL (US); Michael Shulman, Northbrook, IL (US); Paul Furlow, Chicago, IL (US); Gregory Kay, Chicago, IL (US); Wallace Hepkema, Racine, WI (US)

(73) Assignee: Tech Lighting L.L.C., Skokie, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/656,783

(22) Filed: Feb. 16, 2010

(65) Prior Publication Data

US 2010/0271847 A1 Oct. 28, 2010

Related U.S. Application Data

(63) Continuation of application No. 11/650,427, filed on Jan. 8, 2007, now Pat. No. 7,661,870, which is a continuation of application No. 10/366,883, filed on Feb. 14, 2003, now Pat. No. 7,172,332.

(51) Int. Cl.
*F21V 4/00* (2006.01)
*F21V 21/08* (2006.01)

(52) U.S. Cl. ..... 362/648; 362/391; 362/404; 439/111; 174/99 B

(58) Field of Classification Search ..... 362/391, 362/147, 404, 648, 652, 659; 439/110, 111; 174/681, 99 B, 96, 97, 493, 494
See application file for complete search history.

(56) References Cited

U.S. PATENT DOCUMENTS

| | | | |
|---|---|---|---|
| 2,924,687 | A | 2/1960 | Platz |
| 3,089,042 | A | 5/1963 | Hickey et al. |
| 3,246,074 | A | 4/1966 | Neumann et al. |
| 3,273,103 | A | 9/1966 | Ericson |
| 3,569,898 | A | 3/1971 | Laser |

(Continued)

FOREIGN PATENT DOCUMENTS

EP 129 325 A2 12/1984

(Continued)

OTHER PUBLICATIONS

Zumtobel Staff Track Systems Lighting Catalog, Zumtobel Staff Lighting, Inc.; May 2002.

(Continued)

*Primary Examiner* — Stephen F. Husar
*Assistant Examiner* — Peggy A. Neils
(74) *Attorney, Agent, or Firm* — Marshall, Gerstein & Borun LLP

(57) ABSTRACT

A bendable line voltage track lighting system includes a track having a conductor subassembly and first and second bendable sheaths that engage the conductor subassembly. The conductor subassembly includes first and second insulators that receive first and second bus-bars, respectively, and a compression gasket for biasing the two insulators into engagement with guide grooves in the bendable sheaths. Power is fed to the track by power connectors that engage the bus-bars contained within the conductor subassembly. Light fixtures are powered by making electrical contact with the bus-bars of the conductor subassembly.

10 Claims, 13 Drawing Sheets

U.S. PATENT DOCUMENTS

| | | | | |
|---|---|---|---|---|
| 3,801,951 | A | 4/1974 | Kemmerer et al. | |
| 4,099,817 | A | 7/1978 | Booty | |
| 4,514,791 | A | 4/1985 | Tokieda | |
| 4,655,520 | A * | 4/1987 | Cummings | 439/111 |
| 4,747,025 | A | 5/1988 | Barton | |
| 4,861,273 | A | 8/1989 | Wenman et al. | |
| 4,887,196 | A | 12/1989 | Brown et al. | |
| 4,919,625 | A | 4/1990 | Coutre | |
| 5,336,097 | A | 8/1994 | Williamson, Jr. et al. | |
| 5,455,754 | A | 10/1995 | Hoffner | |
| 5,584,576 | A | 12/1996 | Wei Hong | |
| 5,603,622 | A | 2/1997 | Lin | |
| 5,618,192 | A | 4/1997 | Drury | |
| 5,664,876 | A | 9/1997 | Vafai et al. | |
| 5,672,003 | A | 9/1997 | Shemitz et al. | |
| D389,460 | S | 1/1998 | Wei-Hong | |
| 5,772,315 | A | 6/1998 | Shen | |
| 5,833,358 | A | 11/1998 | Patik | |
| 6,022,129 | A | 2/2000 | Tang | |
| 6,079,992 | A | 6/2000 | Kuchar et al. | |
| 6,135,615 | A | 10/2000 | Lee | |
| 6,170,967 | B1 | 1/2001 | Usher et al. | |
| 6,244,733 | B1 | 6/2001 | Fong et al. | |
| 6,274,817 | B1 | 8/2001 | Jaakkola et al. | |
| 6,716,042 | B2 | 4/2004 | Lin | |
| 6,739,740 | B1 | 5/2004 | Feldman | |
| 7,140,888 | B1 * | 11/2006 | Chan | 439/119 |
| 7,172,332 | B2 | 2/2007 | Mobarak et al. | |
| 2002/0064049 | A1 | 5/2002 | Layne et al. | |
| 2003/0031018 | A1 | 2/2003 | Bray et al. | |
| 2007/0153550 | A1 * | 7/2007 | Lehman et al. | 362/648 |
| 2010/0271847 | A1 | 10/2010 | Mobarak et al. | |

FOREIGN PATENT DOCUMENTS

| | | |
|---|---|---|
| GB | 2 189 070 A | 10/1987 |

OTHER PUBLICATIONS

Tech Lighting Catalog, Tech Lighting, LLC 2002.
Juno Trac-Master Lighting Catalog; Juno Lighting; 2002.
Oligo Catalog; OLIGO Lichttechnik GmbH (Germany); Issue 2002.
Zumtobel Track Data Sheets TC-1, TC-1A, TC-2, TC-2A, 2000.
1994 W.A.C. Lighting Brochure.
Sölken Leuchten S2000 Lining Product Drawings.
Undated S2000 Product Brochure.
Elkamet Product Drawing Dated Jul. 17, 1998.

* cited by examiner

FIELD BENDABLE LINE VOLTAGE TRACK LIGHTING SYSTEM

This application is a continuation of application Ser. No. 11/650,427, filed Jan. 8, 2007, now U.S. Pat. No. 7,661,870 which is a continuation of application Ser. No. 10/366,883, filed Feb. 14, 2003, now U.S. Pat. No. 7,172,332, the subject matter of which are incorporated by reference herein in their entirety.

BACKGROUND OF THE INVENTION

The present invention relates generally to a track lighting system; particularly to a field bendable, line voltage track lighting structure and attachable light fixtures.

Both line voltage track systems and low voltage rail systems are widely used in commercial and residential applications because of the flexibility they offer to the end-user to position and later reposition task lighting. Line voltage track systems employ a track powered at a voltage approximately equal to that of the line voltage of an electrical power line entering an enduser's home, building or other structure. In the United States, this voltage is typically 120 VAC. Low voltage rail systems typically employ a rail powered at a voltage substantially less than line voltage. In the United States, low voltage rail systems typically operate between 12 and 24 VAC. Line voltage track systems have the advantage of longer run lengths and greater choice of lamp options. Low voltage rail systems have the advantage of being bendable in the field. This allows for architectural curves and has the further benefit at time of installation of being able to accommodate ceiling obstructions, last minute design changes, and inconveniently located junction boxes. While there is need for a lighting system that combines the advantages of 120 volt track lighting with the advantages of low voltage rail systems, no options have been previously presented because of the difficulties associated with meeting safety standards, including the National Electrical Code requirements and safety laboratory testing standards. Included among the requirements are certain electrical and mechanical tests, including but not limited to an articulated probe finger test, a 50 pound weight support test, a bus bar displacement test, spacing requirements between current-carrying and non current-carrying metal, and a requirement to maintain electrical polarity.

SUMMARY OF INVENTION

The present invention includes a bendable track for a line voltage track lighting system having first and second conductors at least partially enclosed by insulative material. The insulative material has first and second slots to provide access to the first and second conductors, respectively, so that a light fixture can be connected to and powered by the track.

In another aspect, the present invention includes a lighting fixture capable of being connected to a track of a line voltage track lighting system. The lighting fixture includes a track connector with an opening for receiving the track such that when the track is received, the track connector completely surrounds a portion of the track. The track connector includes a first contact pin for engagement of a first conductor-carrying slot in the track and a second contact pin for engagement of a second conductor-carrying slot in the track.

The present invention provides architects and designers with the run lengths and lamp options associated with line voltage track lighting and the field-bendability associated with low voltage rail systems. In addition, the present invention complies with all National Electrical Code requirements and safety laboratory testing standards.

DETAILED DESCRIPTION OF THE PREFERRED EMBODIMENTS OF THE INVENTION

Figure 1:
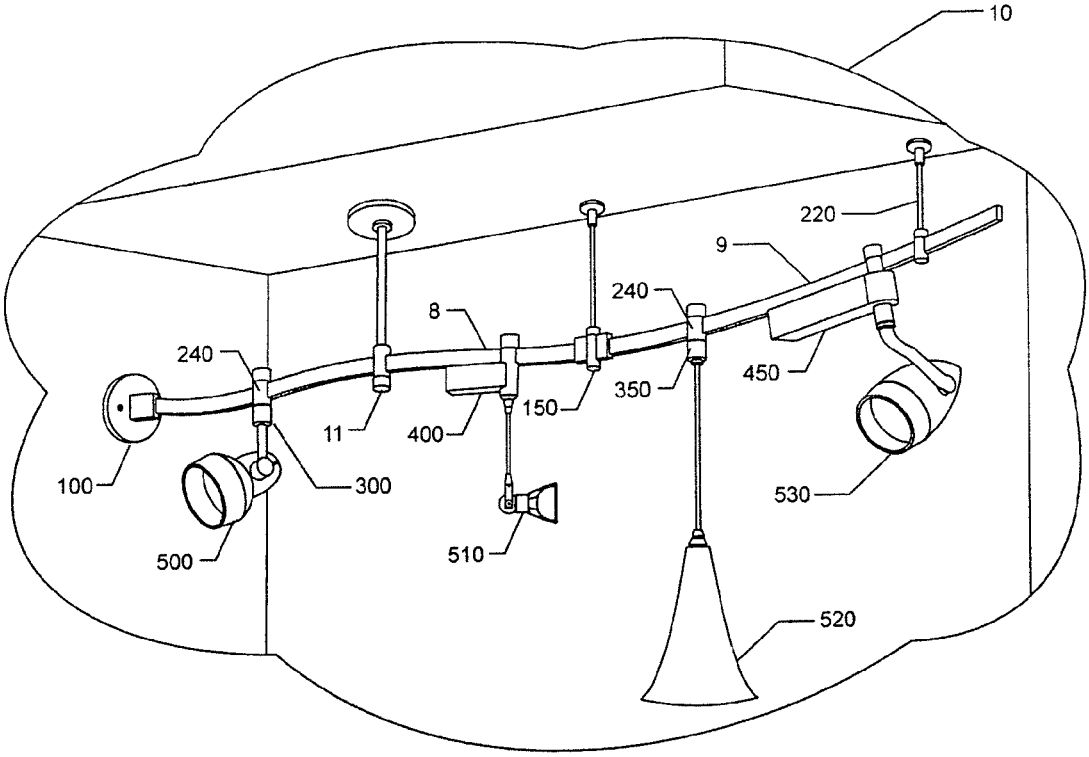
FIG. 1 is a perspective view of one embodiment of the present invention.

Referring now to the drawings, FIG. 1 shows a field-bendable line voltage track system 10. Track pieces, for example tracks 8 or 9, can be joined end-to-end using conductive connectors that carry current from one track to the next. Tracks 8 and 9 are fed electrically through one of a variety of power feed options 11 or 100, which allow for ceiling or wall mounted junction boxes. Mechanical supports 220 are offered with the system to suspend tracks 8 and 9 from a ceiling. Lighting elements 500, 510, 520 and 530 are attached to track 8 or 9 using track fixture connectors.

Figure 2:
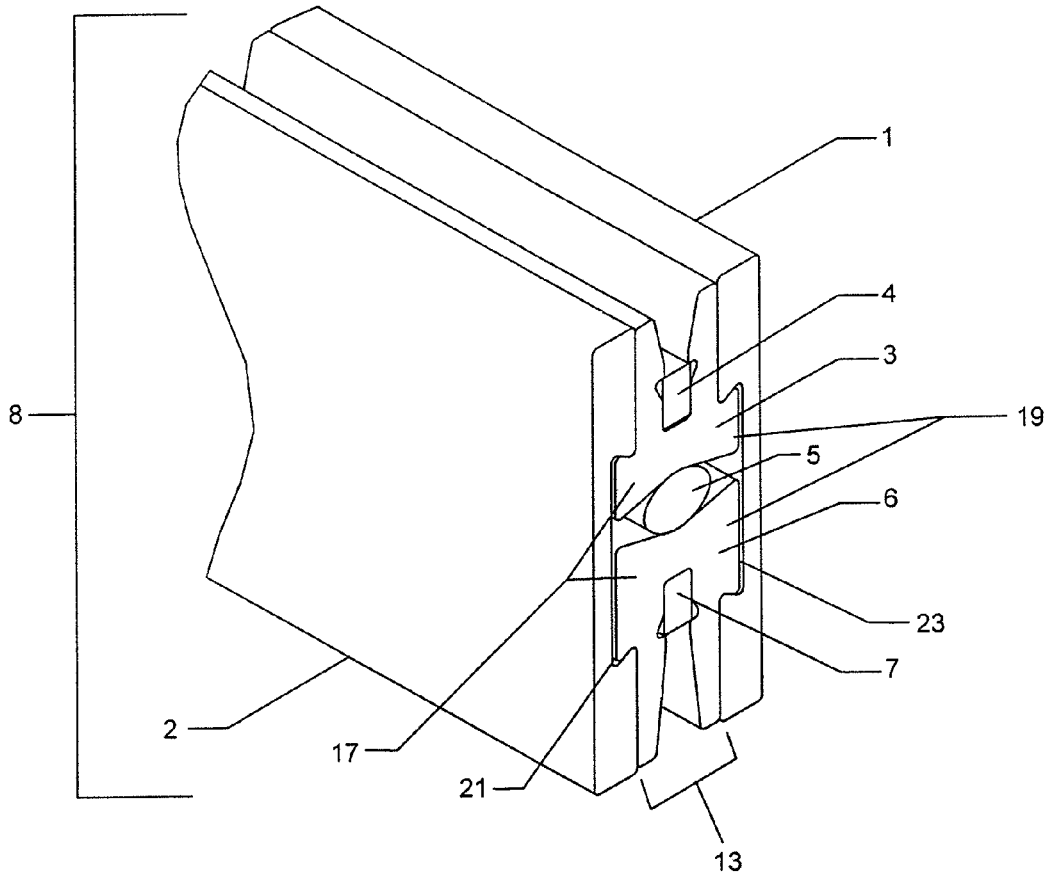
FIG. 2 is a perspective view of the track of one embodiment of the present invention.

The system includes a track 8 or 9 that is easily bendable in a lateral direction by hand. Once it has been bent, the track maintains its new shape. Tracks 8 and 9 are identical in their construction. As best shown in FIG. 2, track 8 includes a conductor subassembly 13 and two external sheaths 1 and 2. The conductor subassembly 13 comprises insulators 3 and 6, each having longitudinal slots for receiving conductive bus-bars 4 and 7, respectively. In one embodiment of the invention, insulators 3 and 6 are constructed of CPVC and bus-bars 4 and 7 are made of copper with a cross-sectional dimension of 0.100"×0.062". Compression gasket 5 is located between insulators 3 and 6 and runs the entire length of the conductor subassembly 13. Compression gasket 5 allows the conductor subassembly 13 to be resiliently compressed to facilitate the engagement of the conductor subassembly 13 by the sheaths 1 and 2. The conductor subassembly 13 forms first and second dovetails 17 and 19 that mate with and are engaged by corresponding guide grooves 21 and 23 in sheaths 1 and 2, respectively.

Track 8 is constructed by first assembling the conductor subassembly 13. Bus-bar 4 is pressed into the longitudinal slot of insulator 3 and bus-bar 7 is pressed into the longitudinal slot of insulator 6. In one embodiment, the insulators 3 and 6 maintain minimum spacings of 0.062" from the bus bars to the external sheaths. Preferably, the bus bars 4 and 7 are positioned at different depths within the conductor subassembly 13 so that the track 8 is polarized. In one embodiment, insulator 3 is shorter than insulator 6, such that the slot depth in insulator 3 is less than that for the slot of insulator 6. For example, the slot depth of insulator 3 is 0.135" from the top of the slot opening to bus-bar 4, while the slot depth in insulator 6 is 0.235" from the bottom of the slot opening to bus-bar 7. The slots in the insulators are also outwardly tapered to make access to the bus-bars easier. After bus-bars 4 and 7 have been inserted, insulator 6 is placed with its opening facing downward. The compression gasket 5 is laid on top of insulator 6, and then sandwiched by insulator 3, which is placed on top of compression gasket 5 with its slot opening facing up. In one embodiment the compression gasket 5 is a cylinder of diameter 0.139" and has a durometer of 40. It should be understood that other resilient structures could be used in place of compression gasket 5.

The conductor subassembly 13 is engaged by sheaths 1 and 2 by transversely compressing the conductor subassembly 13 to narrow the width of the dovetails 17 and 19. Compressed dovetails 17 and 19 are then placed in the corresponding guide grooves 21 and 23 of sheaths 1 and 2. Thereafter, compression of the conductor subassembly 13 is ceased and the compression gasket 5 acts to push the insulators 3 and 6 away from each other, thereby expanding the width of the dovetails 17 and 19 so that the conductor subassembly 13 is slidably engaged by guide grooves 21 and 23 of sheaths 1 and 2. In one embodiment, the sheaths are extruded 6063 aluminum with T52 tempering. In one embodiment, the fully assembled track 8 has a cross-sectional dimension of 0.375" wide by 0.875" tall.

With this construction, the track is able to bend easily. The external sheaths 1 and 2 bend on two separate radii, and conductor subassembly 13 bend on a third radius between the two sheaths. The insulators 3 and 6 are able to slide horizontally along the guide grooves 21 and 23. This sliding allows the three radii to co-exist. Since each component is easily bendable, and the sheaths 1 and 2 are able to move independently from the conductor subassembly 13, the track is easily bendable as well.

When assembled, the track is connected to a source of electric power through a center power feed, direct end power feed, or flexible power feed.

Figure 3A:
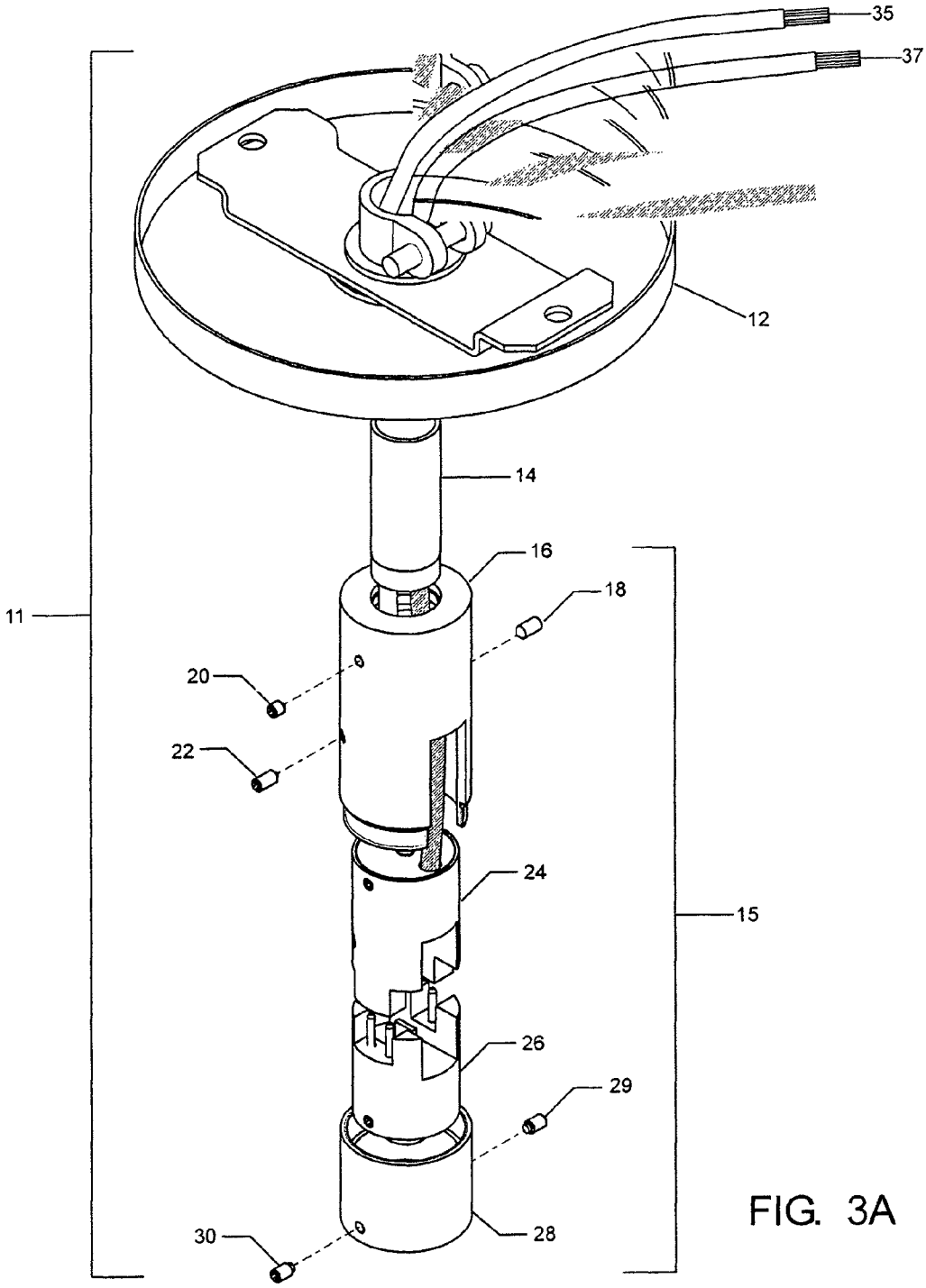
FIG. 3A is an exploded view of a center power feed connector of one embodiment of the present invention.

The construction of a center power feed 11 is best shown in FIG. 3A. Center power feed 11 includes a ceiling canopy assembly 12. A support stem 14 is fixed to ceiling canopy assembly 12 at one end and at the other end is fixed to a power feed cylinder subassembly 15. While a support stem 14 is shown in this specific embodiment, it is to be understood that a flexible conduit with an adapter nipple could alternatively be used. The power feed cylinder subassembly 15 includes a top housing 16 affixed to the support stem 14 and a bottom housing 28 which has a threaded connection to top housing 16. Neutral track connector subassembly 24 is mounted inside of top housing 16 and secured in place by screw 20. Hot track connector subassembly 26 is mounted inside of bottom housing 28 and secured in place by set screws 29 and 30.

Figure 3C:
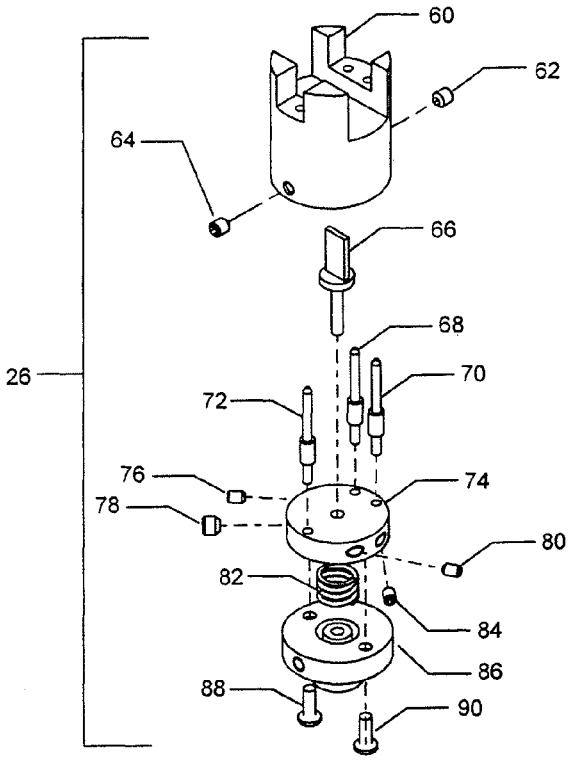
FIG. 3C is an exploded view of a hot track connector subassembly of one embodiment of the present invention.
Figure 3B:
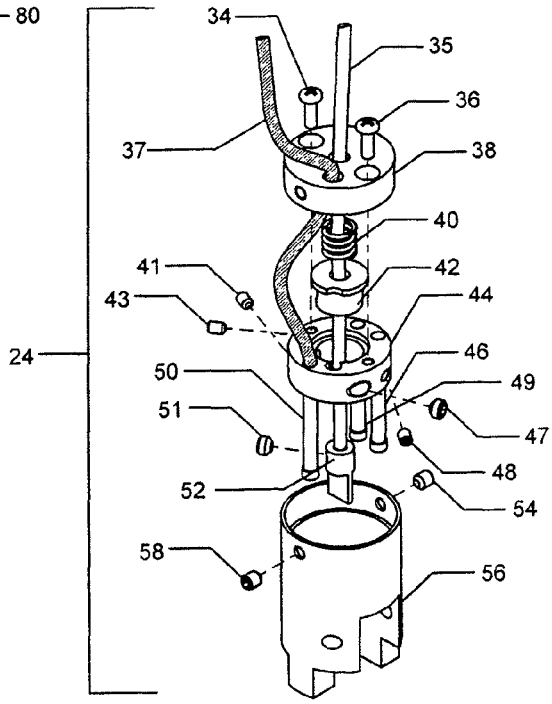
FIG. 3B is an exploded view of a neutral track connector subassembly of one embodiment of the present invention.

Neutral track subassembly 24 is best shown in FIG. 3B. Plastic disk 38 is screwed to metal ring 44 with screws 34 and 36. Spring 40 and insulator 42 are sandwiched between disk 38 and ring 44. Neutral electrical wire 35 runs through plastic disk 38, spring 40, insulator 42 and metal ring 44 and connected to neutral track connector pin 52 with screw 51. Hot electrical wire 37 is run through plastic disk 38 and connected to metal ring 44 using screw 47. Female pin sleeves 46, 49, and 50 are secured to metal ring 44 with screws 41, 43, and 48. Plastic washer 38 is secured to top assembly housing 56 using screws 54 and 58. Neutral track connector pin 52 extends from the top slot in assembly housing 56. Neutral track connector pin 52 is shown as having a blade portion, but alternative connector shapes could also be used. Preferably, assembly housing 56 is made of plastic or some other insulator. In one embodiment, neutral track connector 52 extends from the tope slot in assembly housing 56 by 0.135".

Hot track subassembly 26 is best shown in FIG. 3C. Plastic disk 86 is secured to metal ring 74 by screws 88 and 90. Spring 82 is sandwiched between plastic disk 86 and metal ring 74. Contact pins 68, 70, and 72 are held into ring 74 by screws 76,80, and 84. Hot track connector pin 66 is secured to metal ring 74 by screw 78. Hot track connector pin 66 is shown as having a blade portion, but alternative connector shapes could also be used. Plastic disk 86 is then attached to bottom assembly housing 60 with screws 62 and 64. Preferably bottom assembly housing 60 is made of plastic or some other insulator. In one embodiment, hot track connector pin 66 protrudes 0.235" from the top of the bottom of the slot in bottom assembly housing 60. The hot electrical circuit is connected to the bottom rail connector through the contact pins 68, 70, and 72, the metal ring 74, and the hot track connector pin 66.

Tension on the neutral track connector pin 52 is maintained by spring 40 for a solid connection to bus bar 4. Tension on hot track connector pin 66 is maintained by spring 48 for a solid connection to bus bar 7. When the center power feed 11 is attached to track 8, the neutral bus bar 4 makes contact with neutral track connector 52, and hot bus bar 7 makes contact with hot track connector 34. Track 8 is secured to the center power feed 11 by screws 18 and 22, which establish the ground connection for the external sheaths 1 and 2. Track 8 will not fit into the center power feed 11 in the wrong orientation, because track connector pins 52 and 66 are long and short and the slots within the insulators are long and short.

Figure 4A:
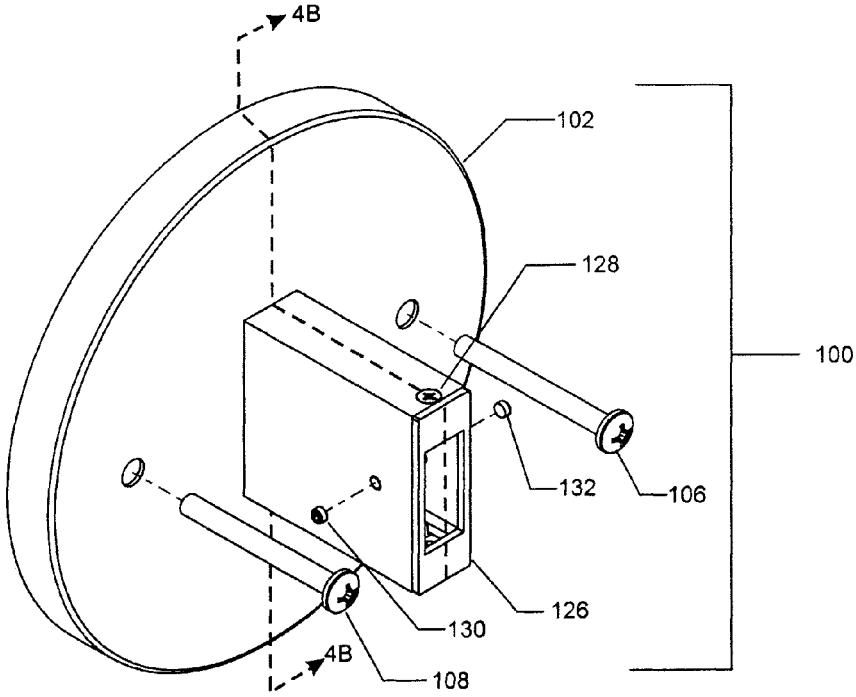
FIG. 4A is an exploded view of a direct end power feed connection of one embodiment of the present invention.
Figure 4B:
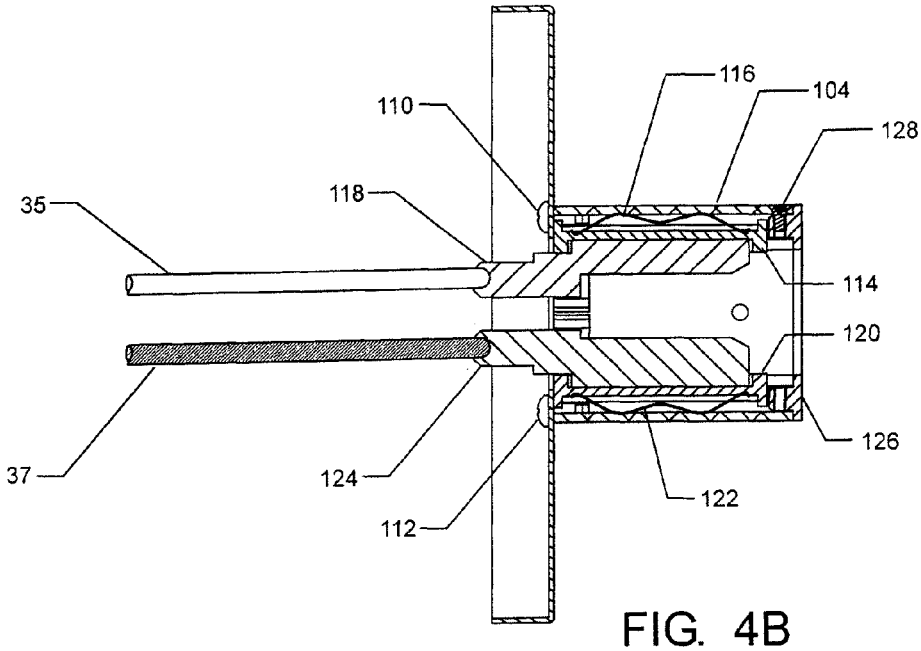
FIG. 4B is a cross-sectional view of the direct end power feed connection shown in FIG. 4A, taken along line 4B-4B.

The construction of direct end power feed 100 is best shown in FIG. 4A and FIG. 4B. Wall disk 102 affixes to standard electrical boxes by screws 106 and 108. Extrusion housing 104 is attached to wall disk 102 with screws 110 and 112. Neutral track contact 118 and hot track contact 124 are snapped into insulators 114 and 120 respectively, and together are held in extrusion housing 104 under tension from springs 116 and 122. Neutral track contact 118 and hot track contact 124 are preferably blade-shaped; however, other shapes could be used that provide good electrical contact with the bus-bars 4 and 7. In one embodiment, neutral track contact 118 extends 0.135" vertically below the top of the opening of end cap 126 and hot track contact 122 extends 0.235" vertically above the bottom of the opening of end cap 126. End cap 126 is assembled to the end of extrusion housing 104 with screw 128. Track 8 is slid into direct end power feed 100 with the neutral bus bar 4 making contact with neutral contact 118, and hot bus bar 7 making contact with hot contact 124. Once inserted, track 8 is secured to the direct end power feed 100 by screws 130 and 132, which establish the ground connection for the external sheaths 1 and 2. Track 8 will not fit in to direct end power feed 100 in the wrong orientation because of the asymmetry of the track and the neutral and hot track connectors.

Figure 5A:
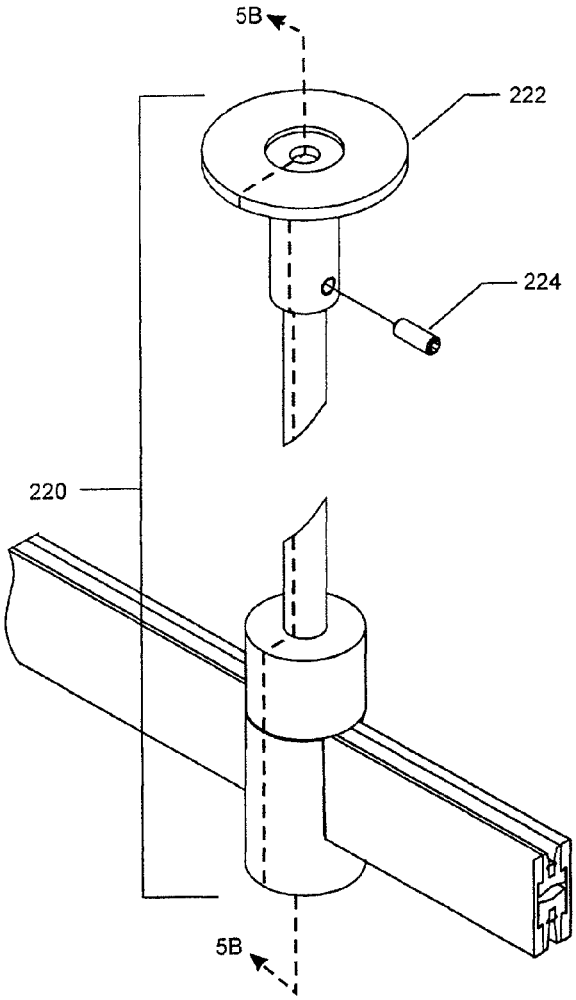
FIG. 5A is an exploded view of a rigid stand-off of one embodiment of the present invention.
Figure 5B:
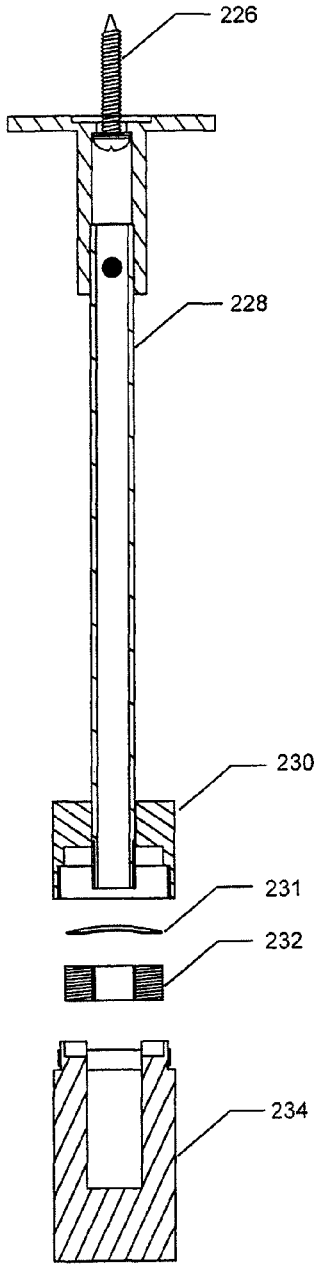
FIG. 5B is a cross-sectional view of the rigid stand-off shown in FIG. 5A, taken along line 5B-5B.

As shown in FIG. 1, tracks 8 and 9 may be suspended from the ceiling using stand-off 220. The construction of stand-off 220 is best shown in FIG. 5A and FIG. 5B. Stand-off 220 has a stemholder 222 that connects to the ceiling by screw 226. Screw 224 locks stem 228 into stemholder 222. While stem 228 is a rigid stem in this specific embodiment, it is understood that cable could also be used. At the bottom of stem 228 is a washer 231 and a nut 232 that support top housing 230. Bottom housing 234 also has a channel to hold track 8 and threads into top housing 230.

Figure 6A:
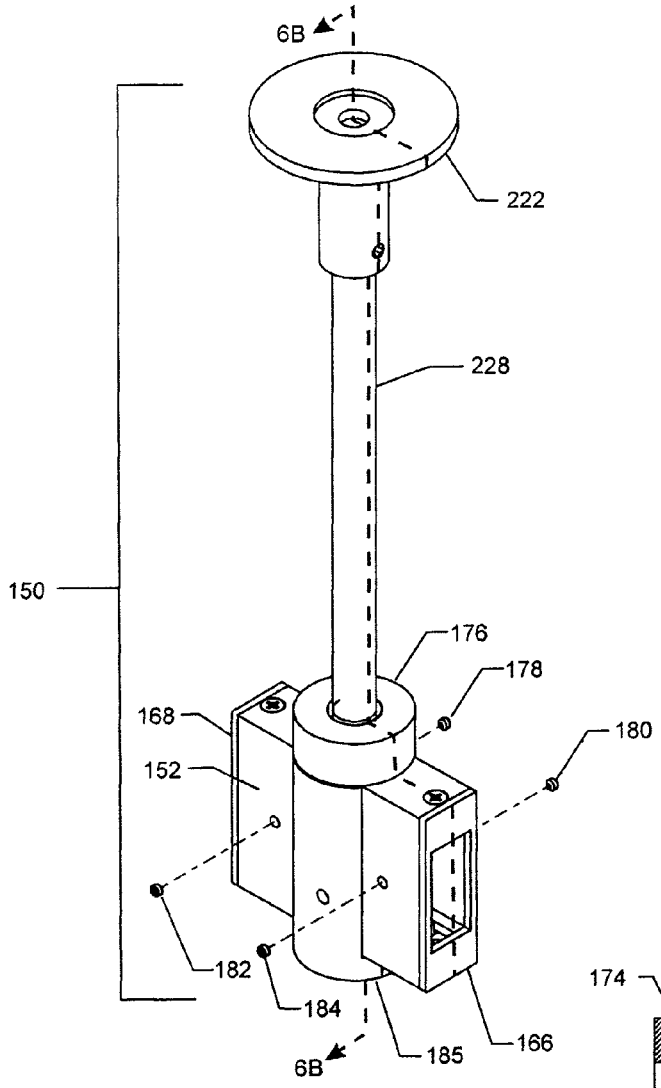
FIG. 6A is an exploded view of a conductive connector of one embodiment of the present invention.
Figure 6B:
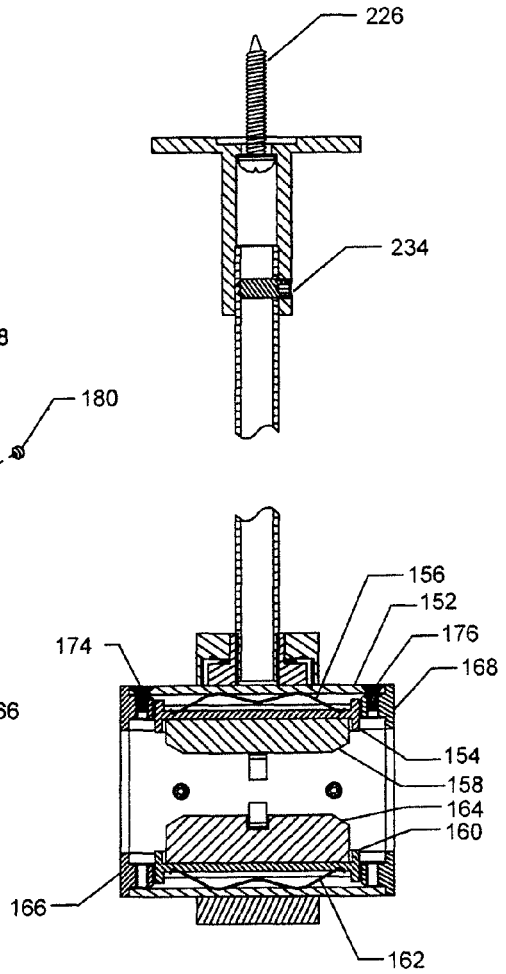
FIG. 6B is a cross-sectional view of the conductive connector shown in FIG. 6A, taken along line 6B-6B.
Figure 7A:
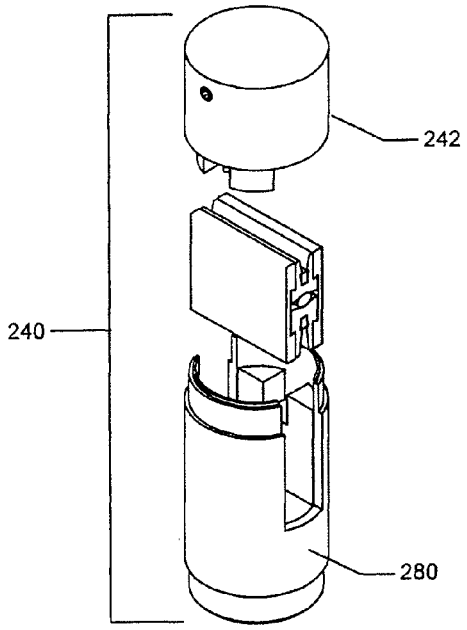
FIG. 7A is an exploded view of a line voltage fixture track connector of one embodiment of the present invention.

As shown in FIG. 1, tracks 8 and 9 are connected end to end by conductive connector 150 and the electrical circuit is maintained through the connector. Conductive connector 150 is best shown in FIG. 6A and FIG. 6B. Conductive connector 150 consists of extrusion housing 152 with end plates 166 and 168, which are secured by screws 174 and 176. End plates 166 and 168 define openings for receiving ends of two tracks 8 and 9 to be joined. Inside the top of housing 152 is a plastic insulator 154. Neutral track contact 158 is snapped into insulator 154. Neutral track contact 154 is preferably blade-shaped; however, other shapes could be used that provide good electrical contact with bus-bar 4. Spring 156 provides tension to plastic insulator 154 and neutral track contact 158. Inside the bottom of housing 152 is a plastic insulator 160. Hot contact 164 is snapped into insulator 160. Spring 162 provides tension to plastic insulator 160 and hot track contact 164. Hot track contact 164 is preferably blade-shaped; however, other shapes could be used that provide good electrical contact with bus-bar 7. In one embodiment, hot track contact 164 extends 0.235" above the bottom of the opening of end caps 166 and 168 and neutral track contact 158 extends 0.135" below the top of the opening of end caps 166 and 168. Insulators 154 and 160 have vertical stubs that provide a mechanical stop to center tracks 8 and 9 into the connector 150. Tracks 8 and 9 will not fit into conductive connector 150 in the wrong orientation. Screws 178, 180, 182, and 184 are threaded through the extrusion housing 152 to connect to the external sheaths of both track 8 and track 9 to provide mechanical fastening and continuation of grounding. Conductive connector 150 may instances be used with a stand-off, as shown in FIG. 7A. In this embodiment, housing 176 threads to housing 185 with the conductive connector in the slot of housing 185. Housing 176 is attached to stem 228 with screw 178. Stem 228 is attached at the top end to stemholder 222.

Figure 7B:
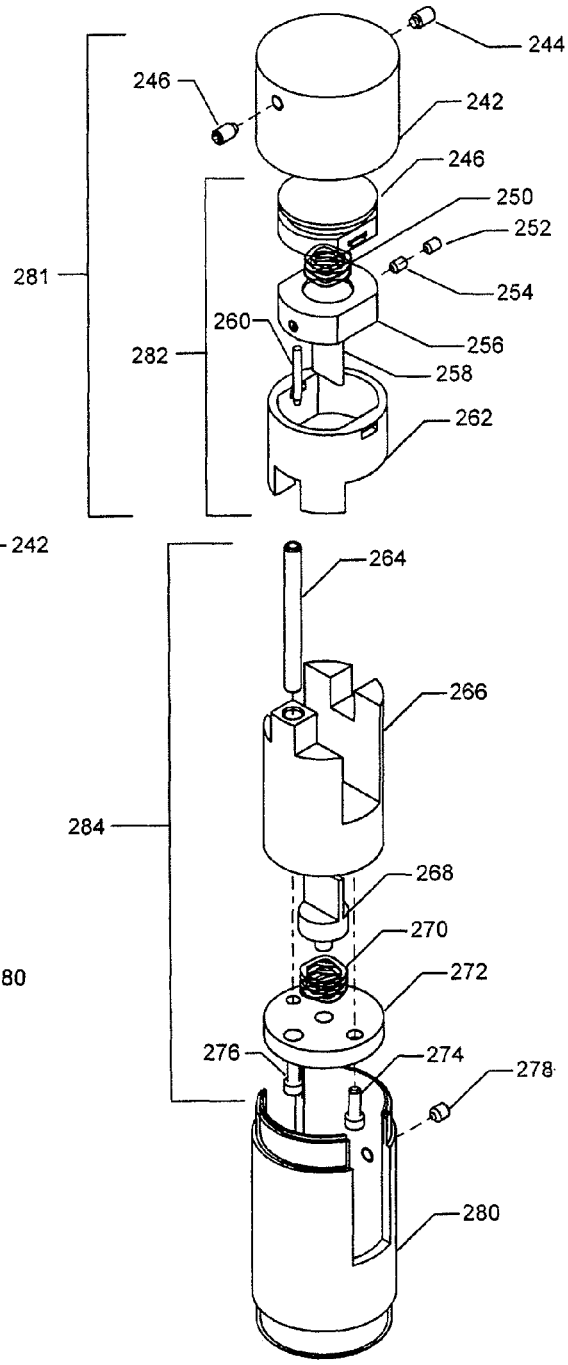
FIG. 7B is a further exploded view of a line voltage fixture track connector of one embodiment of the present invention.

As shown in FIG. 1, line voltage light fixtures such as fixtures 500 and 520 may be connected to track 8 or 9. Line voltage fixtures connect to the track through line voltage fixture track connector 240, best shown in FIG. 7A and FIG. 7B. Line voltage fixture track connector 240 includes bottom housing 280 and a top housing 242. Top housing 242 threads to bottom housing 280 to define an opening for receipt of track 8 therethrough such that the line voltage fixture track connector 240 completely surrounds a portion of track 8. Neutral track connector subassembly 282 is retained within top housing 242 with screws 244 and 246, and may rotate freely. Within neutral track connector subassembly 282, insulator cap 246 snaps to plastic insulator 262 to hold spring 250, metal ring 256 and neutral track contact pin 258 in place. Contact pin 260 is secured to ring 256 with screw 254. Screw 252 secures neutral track contact pin 258 to ring 256. Neutral track contact pin 258 is preferably blade-shaped; however, other shapes could be used that provide good electrical contact with bus-bar 4. In one embodiment, neutral track contact pin 258 extends 0.135" below the bottom edge of top housing 242.

Plastic insulator 262 has three plastic prongs protruding from its base, that act as locators to housing 266 when the top housing 242 is placed on the track and threaded to bottom housing 280. Hot track connector subassembly 284 is held into bottom housing 280 with screw 278. Within hot track connector subassembly 284, plastic insulator 272 is screwed to plastic housing 266 with screws 274 and 276, which sandwiches in place spring 270 and hot contact pin 268. Hot track contact pin 268 is preferably blade-shaped; however, other shapes could be used that provide good electrical contact with bus-bar 7. In one embodiment, hot contact pin 268 extends 0.235" above the bottom of the slot opening in bottom housing 280. Pin sleeve 264 is pressed into plastic housing 266. Pins 310 and 308 of intermediate head connector 300 or pins 358 and 360 of intermediate pendant connector 350 mate with contact pin 268 and pin sleeve 264, respectively, from the bottom when the intermediate head connector 300 or intermediate pendant connector 350 is screwed to bottom housing 280.

Power from the neutral bus bar 4 is carried to the fixture through neutral track contact pin 258, metal ring 256, contact pin 260, pin sleeve 264, and to the neutral pin on the head connector 300 or pendant connector 350. Power from the hot bus bar 7 is carried to the fixture through hot track contact pin 268 straight to the hot pin on the head connector 300 or pendant connector 350.

Figure 8A:
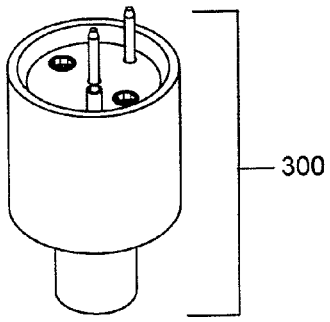
FIG. 8A is a perspective view of a head connector of one embodiment of the present invention.
Figure 8B:
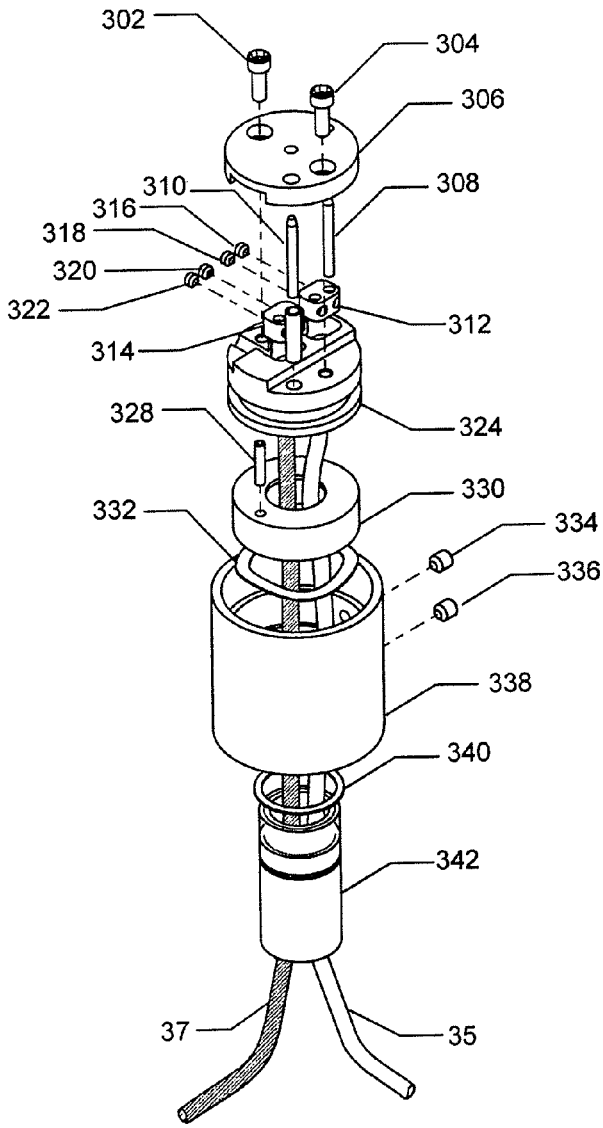
FIG. 8B is an exploded view of the head connector shown in FIG. 8A.

Light fixtures with rigid stems, such as fixture 500 in FIG. 1, may connect into line voltage fixture track connector 240 by using intermediate head connector 300, as shown in FIG. 8A and FIG. 8B. Rigid stem 342 screws into nut 330. Retaining ring 340 fits into a retaining groove on stem 342 and pulls nut 330 snug with compression washer 332 and housing 338. Screw 336 hits nut 330 as a locking screw to permanently locate stem rotation. Stem 328 is pressed into nut 330 as an anti-rotation device that prohibits stem 342 from rotating more than 350 degrees. Plastic insulators 306 and 324 are held together by screws 302 and 304. Contact pins 308 and 310 are secured to wiring terminals 312 and 314 by screws 316 and 320. The hot wire 37 that feeds through the rigid stem is secured to wiring terminal 314 by screw 322. The neutral wire 35 that feeds through the rigid stem is secured to wiring terminal 312 by screw 318. Plastic insulator 324 is retained to housing 338 by screw 334. Neutral contact pin 308 and hot contact pin 310 are asymmetrically located to preserve electrical polarity. Hot contact pin 310 is in the middle of head connector 300, and neutral contact pin 308 is off center. The rigid stem and the housings act as the ground connection. Neutral electrical wire 35 and hot electrical wire 37 are connected to neutral and hot lamp contacts, respectively (not shown), that mate with a line voltage lamp (not shown).

Figure 9A:
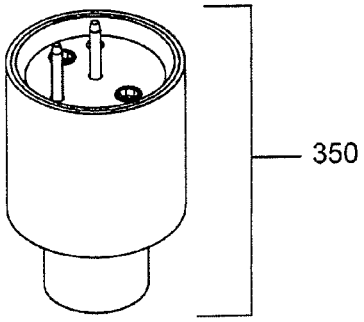
FIG. 9A is a perspective view of a pendant connector of one embodiment of the present invention.
Figure 9B:
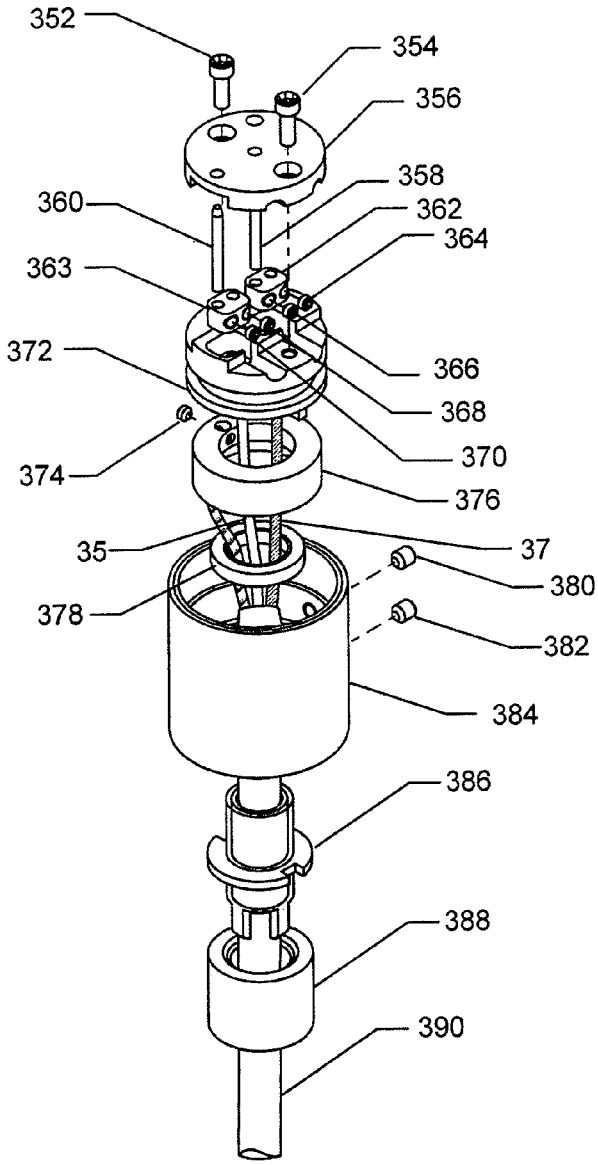
FIG. 9B is an exploded view of the pendant connector shown in FIG. 9A.

Light Fixtures such as 520 that are supported by cable connect into line voltage track connector 240 by using intermediate pendant connector 350, as shown in FIG. 9A and FIG. 9B. 18/3 cable 390 feeds through metal cap 388 to strain relief 386 and into housing 384. Nut 378 attaches to the strain relief 386 and holds the cable 390 in place. Screw 382 secures ring 376 in place. Plastic insulators 356 and 372 are held together by screws 352 and 354. Pins 358 and 360 are secured to wiring terminals 362 and 363 by screws 366 and 370. The ground wire from the 18/3 cable 390 is placed in ring 376 and secured with ring 374. The hot wire that feeds from cable 390 passes through ring 376 and into wiring terminal 363 and is secured by screw 368. The neutral wire that feeds from cable 390 passes through ring 376 and into wiring terminal 362 and is secured by screw 364. Plastic insulator 372 is retained to housing 384 by screw 380. The pins are asymmetrically located to preserve electrical polarity in the same way as in intermediate head connector 300. Neutral electrical wire 35 and hot electrical wire 37 are connected to neutral and hot lamp contacts, respectively (not shown), that mate with a line voltage lamp (not shown).

Figure 10A:
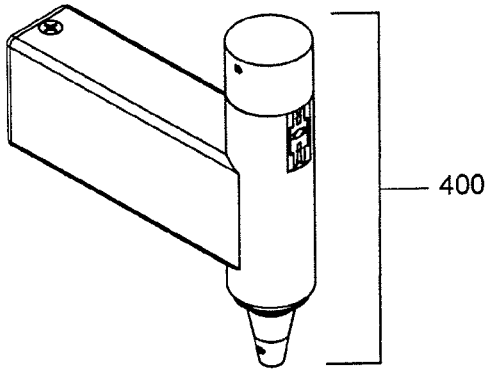
FIG. 10A is a perspective view of a low voltage fixture track connector of one embodiment of the present invention.
Figure 10B:
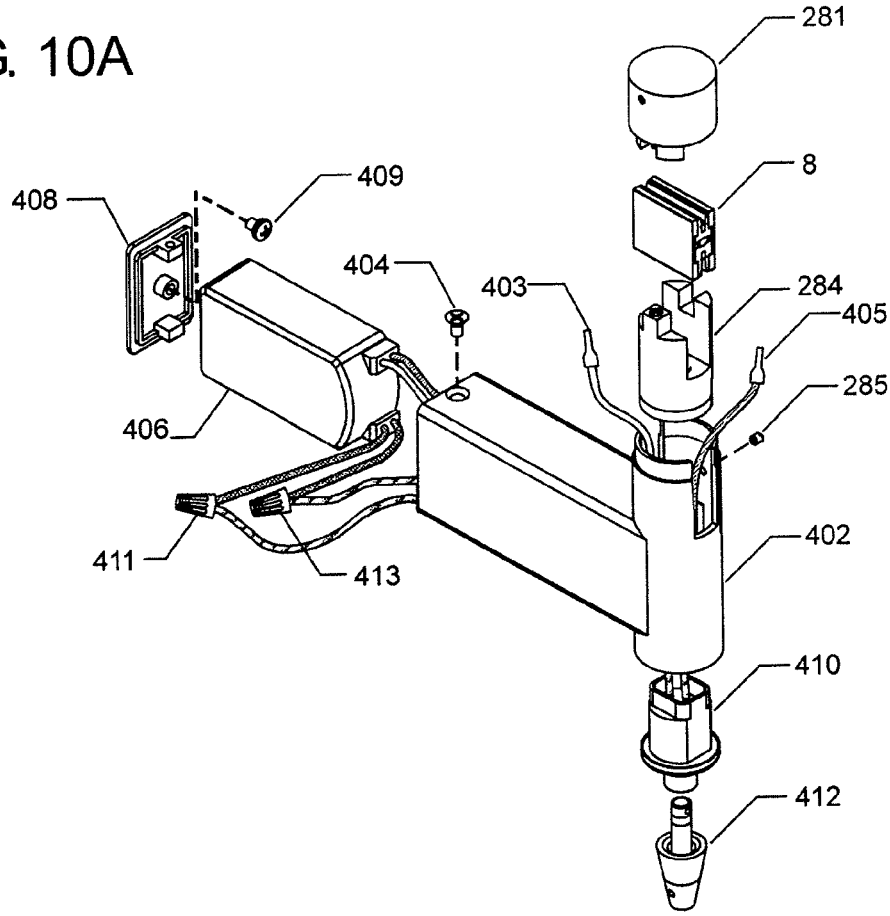
FIG. 10B is an exploded view of the low voltage fixture track connector shown in FIG. 10A.

As shown in FIG. 1, low voltage light fixtures such as 510 may be connected to the track. Low voltage light fixtures connect to track 8 through low voltage fixture track connector 400, best shown in FIG. 10. Casting 402 has a threaded top stem that encloses hot track connector subassembly 284 (described above) and is secured in place by screw 285. Fixture track connector cap subassembly 281 (described above) screws onto the top stem of casting 402 and encloses track 8. Fixture track connector cap subassembly 281 will only thread fully if track 8 is in the proper orientation. Inserted at the end of casting 402 is a low voltage output transformer 406 that is commonly available. It is understood that other wattage or voltage transformers could easily be substituted. Screw 404 holds end cap 408 in place to close off the casting 402. The ground wire from the transformer is affixed to the end cap with ground screw 409. Female connector 410 is screwed into the base of casting 402. Low voltage lamps may attach to the female connector 410 with a connector 412 such as that shown in U.S. Pat. No. 6,183,297, the contents of which is hereby incorporated by reference, or a similar rigid stem connector. The hot and neutral contacts from the female connector are connected with wires and wire nuts 411 and 413 to the low voltage lead wires from the transformer. The 120 volt lead wires from the transformer are crimped to pins 403 and 405 and inserted into the subassembly 284.

Figure 11A:
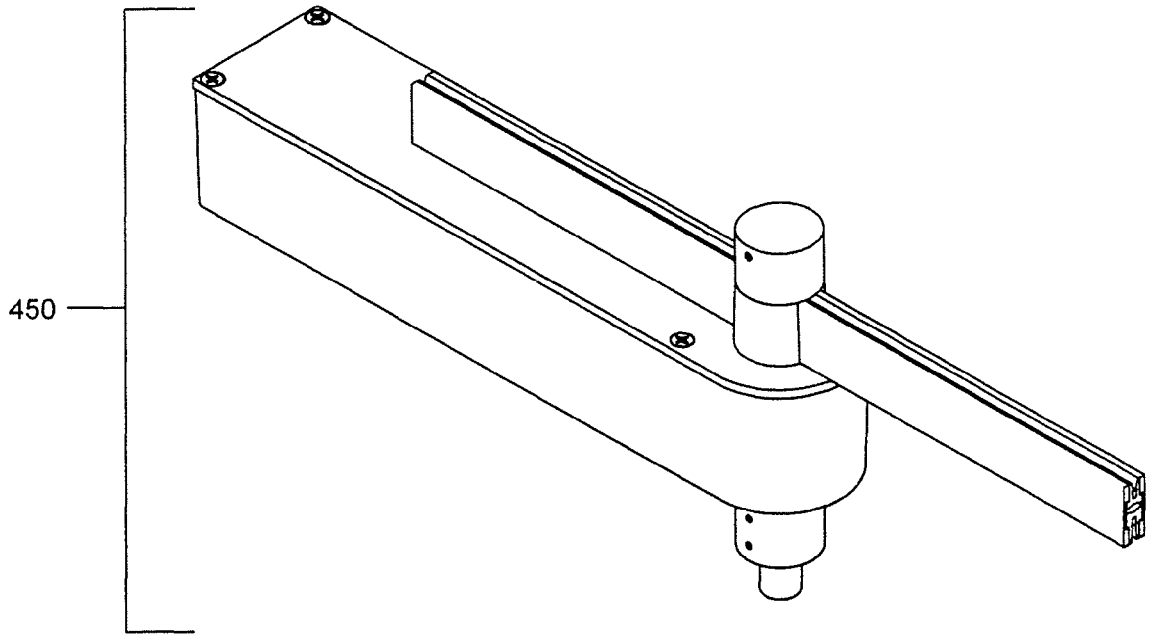
FIG. 11A is perspective view of a metal halide fixture track connector of one embodiment of the present invention.
Figure 11B:
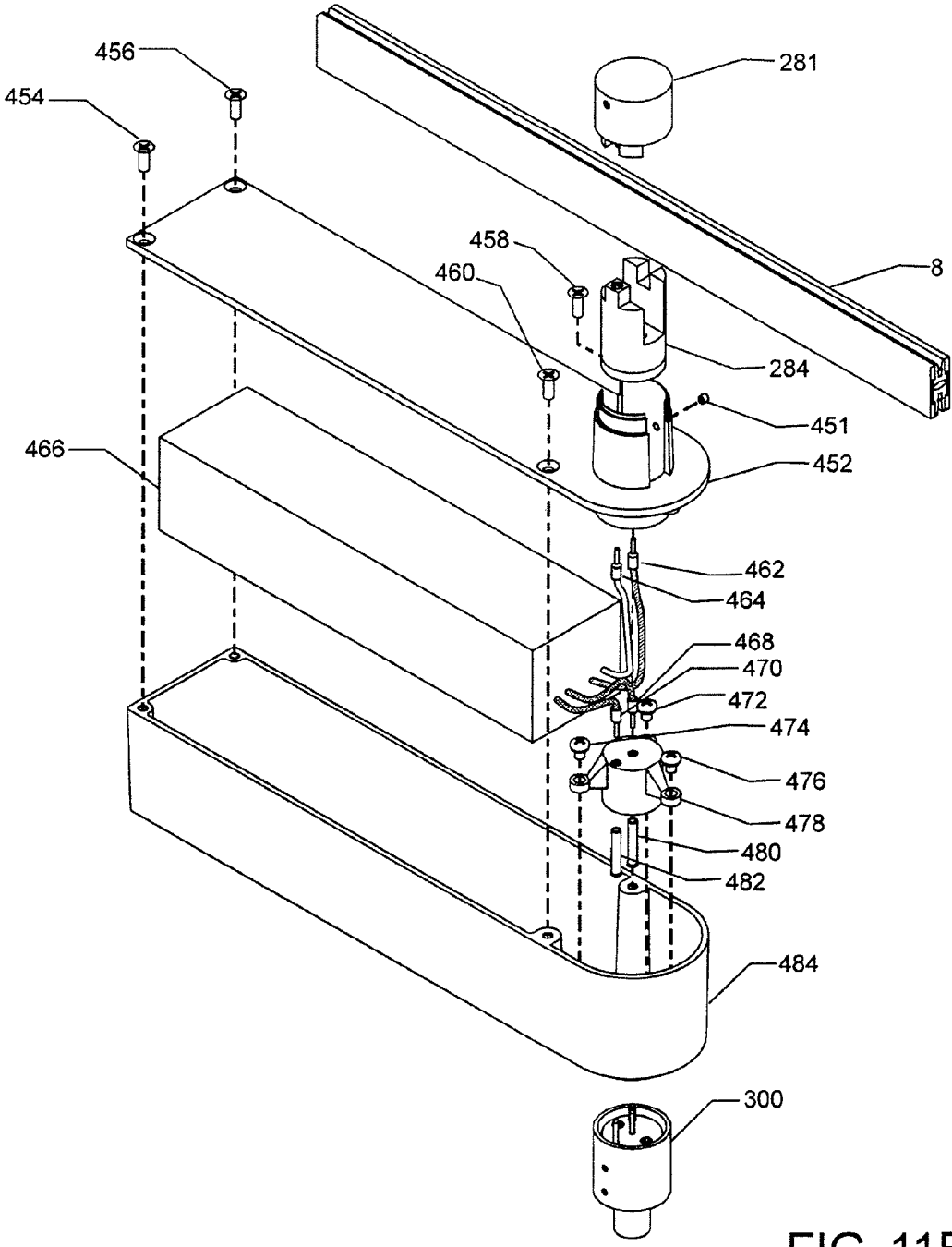
FIG. 11B is an exploded view of the metal halide fixture track connector shown in FIG. 11A.

As shown in FIG. 1, metal halide light fixtures such as 530 may be connected to the track. Metal halide light fixtures connect to track 8 through metal halide track connector 450 and either track fixture connector 300 or pendant fixture connector 350, as the case may be. Metal halide track connector 450 is best shown in FIG. 11A and FIG. 11B. Fixture track connector cap subassembly 281 threads onto the stem of cover 452 and secures the metal halide track connector 450 to track 8. The metal halide ballast 466, commonly available in a variety of wattages, is contained within housing 484 and secured with cover 452 and screws 454, 456, 458, and 460. Hot track connector subassembly 284 is held into cover 452 with screw 451. Ferrules 462 and 464 are inserted into the hot track connector subassembly 284. Hot and neutral metal halide ballast primary wires are attached to ferrules 462 and 464. The metal halide lamp supply wires are attached to ferrules 468 and 470, and are inserted onto sockets 480 and 482, which are contained within the fixture connector adapter insulator 478. The fixture connector adapter insulator is secured to housing 484 with screws 472, 474, and 476. A line voltage fixture connector 300 or pendant connector 350 may then be threaded onto housing 484.

The track lighting system of the present invention, at least in one embodiment meets all National Electrical Code requirements and national safety laboratory testing requirements for line voltage track systems. In one embodiment, the openings on the insulators 3 and 6 are small enough that they prevent an articulated finger probe from making contact with the bus bars 4 and 7; the track supports 50 pound weights between supports 4 feet apart from each other; the bus bars 4 and 7 do not displace from the insulators 3 and 6 under 2 pounds of force; the conductive bus-bars 4 and 7 are at all points at least 1/16" from any non-current-carrying conductive materials such as the external sheaths; the track system maintains electrical polarity via the different slot dimensions in the insulators 3 and 6; the power feed and track fixture connectors that mount to the track each have a long contact at the bottom to make electrical contact with the bottom bus-bar 7 and a short contact at the top to make electrical contact with top bus-bar 4, thus making it physically impossible for the power feeds or track fixture connectors to make electrical contact in the wrong orientation.

Although the present invention has been described with a certain degree of particularity, it is to be understood that the present disclosure has been made by way of example only and that many possible modifications and variations can be made without departing from the scope and spirit of the present invention. While certain dimensions and materials have been set forth for particular embodiments, they are not meant to be limiting, and it is to be understood that many alternative dimensions or materials could be used.

What is claimed is:

1. A line voltage track lighting system comprising:

a bendable track having first and second conductors, at least one of the first and the second conductors generally aligned with a longitudinal axis passing through a center of the track, the first conductor having a first vertical position, and the second conductor having a second vertical position;

a power feed for supplying line voltage to said first and second conductors; and a light fixture attached to said first and second conductors of said bendable track.

2. A track for a line voltage track lighting system comprising:

a conductor subassembly;

a first bendable sheath for slidably engaging a first portion of said conductor subassembly; and a second bendable sheath for slidably engaging a second portion of said conductor subassembly.

3. The track of claim 2 wherein said conductor subassembly includes an insulator structure for receiving first and second bus-bars.

4. The track of claim 3 wherein said insulator structure includes first and second insulators for receiving said first and second bus-bars, respectively.

5. The track of claim 4 wherein said first and second insulators together form first and second sheath engaging structures.

6. The track of claim 5 wherein said first and second sheaths define first and second guide grooves for slidably engaging said first and second sheath engaging structures.

7. The track of claim 6 wherein said first and second sheath engaging structures are dovetails.

8. The track of claim 4 wherein said first and second insulators define first and second slots, respectively, for receiving said first and second bus-bars, respectively.

9. The track of claim 8 wherein said first slot has a first depth and said second slot has a second depth different from said first depth.

10. A track for a line voltage track lighting system comprising:

first and second conductors at least partially enclosed by insulative material, at least one of the first and the second conductors generally aligned with a longitudinal axis passing through a center of the track, the first conductor having a first vertical position, and the second conductor having a second vertical position;

said insulative materials defining first and second slots;

said first and second slots providing access to said first and second conductors, respectively, such that a light fixture may be connected to and powered by said track;

wherein said track is hand bendable.

* * * * *